US007010928B2

(12) United States Patent
Spanger

(10) Patent No.: US 7,010,928 B2
(45) Date of Patent: Mar. 14, 2006

(54) CLAMP ASSEMBLY FOR CONDENSATE DRAIN PAN OVERFLOW DETECTOR

(76) Inventor: Gerald S. Spanger, 402 Merrywood Dr., Edison, NJ (US) 08817

( * ) Notice: Subject to any disclaimer, the term of this patent is extended or adjusted under 35 U.S.C. 154(b) by 116 days.

(21) Appl. No.: 10/747,197

(22) Filed: Dec. 30, 2003

(65) Prior Publication Data

US 2005/0138940 A1 Jun. 30, 2005

(51) Int. Cl.
*F25D 21/00* (2006.01)
*A47B 96/06* (2006.01)

(52) U.S. Cl. ..... 62/150; 248/229.15

(58) Field of Classification Search ..... 62/150, 62/285, 286, 291, 272; 248/229.15, 229.25, 248/229.14, 229.12

See application file for complete search history.

(56) References Cited

U.S. PATENT DOCUMENTS 5,603,127 A 2/1997 Veal
6,178,564 B1 1/2001 Leonard et al.
6,230,334 B1 5/2001 Camp et al.
6,389,610 B1 5/2002 Hautmann et al.
6,412,120 B1 7/2002 Leonard et al.
6,591,431 B1 7/2003 Hautmann et al.

OTHER PUBLICATIONS

"Condensate Overflow Protector"; Beckett Corporation.
"Drain Pan Pump".
"Wet Switch Stop the Flood"; Wagner Manufacturing.
"AquaSwitch"; EDC International Ltd.
"Low Voltage Auxiliary Condensate Switch"; Little Giant Pump Company.
Hartell Pumps.
"Model J-99, J-100 Instructions"; Milton Roy Hartell Division.
"Safety Float Switch".

*Primary Examiner*—Chen Wen Jiang
(74) *Attorney, Agent, or Firm*—Oliff & Berridge PLC

(57) ABSTRACT

A clamp assembly for mounting devices such as a condensate over detection and/or prevention mechanism to a drain pan of an air cooling system includes first and second clamp members that are attachable to each other. The first clamp member includes a first engaging portion that engages a first surface of the drain pan, and the second clamp member includes a second engaging portion that engages a second surface of drain pan. The assembly includes a locking mechanism that locks the first and second clamp members to each other so that the pan is clamped between the first and second clamp members.

38 Claims, 7 Drawing Sheets

CLAMP ASSEMBLY FOR CONDENSATE DRAIN PAN OVERFLOW DETECTOR

BACKGROUND OF THE INVENTION

1. Field of Invention

The present invention relates to a clamp assembly, and in particular to a clamp assembly for a condensate overflow detection and/or prevention mechanism for use in an air cooling system.

2. Description of Related Art

An air cooling system, such as an air conditioner or a heat pump, typically has heat exchange coils that produce condensate as the system cools air in a building. The condensate can cause damage to structures within the building, such as dry wall, ceilings, wooden supports, etc. Thus, the condensate is collected in a drain pan placed below the heat exchange coils, and is transported away through a drain line connected to the drain pan. Over a period of time, blockage can occur in the drain pan or the drain line due to debris, algae or other biological matter. The blockage causes the condensate to accumulate in the drain pan, and eventually, overflow to cause damage to the building. Accordingly, it is desirable and known to attach a mechanism to the drain pan that detects the build-up of condensate due to a blockage and/or prevents overflow by shutting off the cooling system, sounding an alarm, and/or pumping away the condensate.

SUMMARY OF THE INVENTION

There are various problems associated with attaching a condensate overflow detection and/or prevention mechanism to a drain pan. The condensate overflow detection and/or prevention mechanism may be attached to the drain pan using screws, bolts or rivets. However, making a hole in the drain pan may result in leakage of condensate. Further, drain pans recently are made of plastic, and thus making a hole in the drain pan may weaken its structural integrity resulting in structural failure of the drain pan.

A less intrusive method would be to use a clamp or a bracket that attaches to the drain pan and to which the overflow detection/prevention mechanism is mounted. The condensate overflow detection and/or prevention mechanism may be attached to the clamp or bracket; thereby the structural integrity of the drain pan is maintained. However, using an inadequate clamp or bracket results in the condensate overflow detection and/or prevention mechanism being easily dislodged or mis-aligned, for example, by a workman brushing against it or catching on a cable of the mechanism. In addition, rodents may pull on the cable of the condensate overflow detection and/or prevention mechanism while attempting to gnaw off the insulation, which also could move the mechanism from its desired position.

Drain pans also come in various shapes. Many of the plastic drain pans are fabricated with an angled vertical side that slopes at an angle, for example, between 10 and 15 degrees or more. Other pans have vertical sides. If a clamp or a bracket is not designed to attach to a sloped vertical side, the condensate overflow detection and/or prevention mechanism may not operate properly, because it will not be installed at the desired orientation.

Additionally, to improve the strength of plastic drain pans, a rolled reinforcing lip may be provided at the top of the side of the drain pan to prevent buckling or bending. In order to fit a clamp or bracket, it may be necessary to cut away the reinforcing lip to attach a standard clamp or bracket. However, such action degrades the structural integrity of the sloping side.

Various aspects of the invention seek to provide a clamp for mounting a condensate overflow detection and/or prevention mechanism to any type of drain pan, which addresses one or more of the issues described above.

According to one aspect of the invention, the clamp assembly includes first and second clamp members that are attachable to each other. The first clamp member includes a first engaging portion that engages a lower surface of a drain pan. The second clamp member includes a second engaging portion that engages an upper surface of the drain pan. The assembly includes a locking mechanism that locks the first and second clamp members to each other so that the drain pan is clamped between the first and second clamp members. The second clamp member includes a mounting member to which a condensate overflow detection and/or prevention mechanism can be attached.

Preferably the mounting member is adjustably attachable to the second clamp member so that the level of the detection and/or prevention mechanism is adjustable.

According to one embodiment, the second clamp member is U-shaped, and the first clamp member is L-shaped. This embodiment is suited for clamping onto a vertical side of a drain pan. The U-shaped clamp member has an inner surface that saddles a side of the drain pan. At a first end of the U-shaped clamp member, there is a mating portion that mates with a mating portion of the L-shaped clamp member to define the locking mechanism.

The L-shaped clamp member may have the mating portion at one arm which mates with the mating portion of the U-shaped clamp member. The L-shaped clamp member may have at least a portion of an inner surface of another arm that partially abuts a bottom of the drain pan.

These and other features and advantages of the invention are described in, or are apparent from, the following description of various exemplary embodiments of the invention.

BRIEF DESCRIPTION OF THE DRAWINGS

Various exemplary embodiments of the invention are described in detail with reference to the following figures in which.

DETAILED DESCRIPTION OF EXEMPLARY EMBODIMENTS

Figure 1:
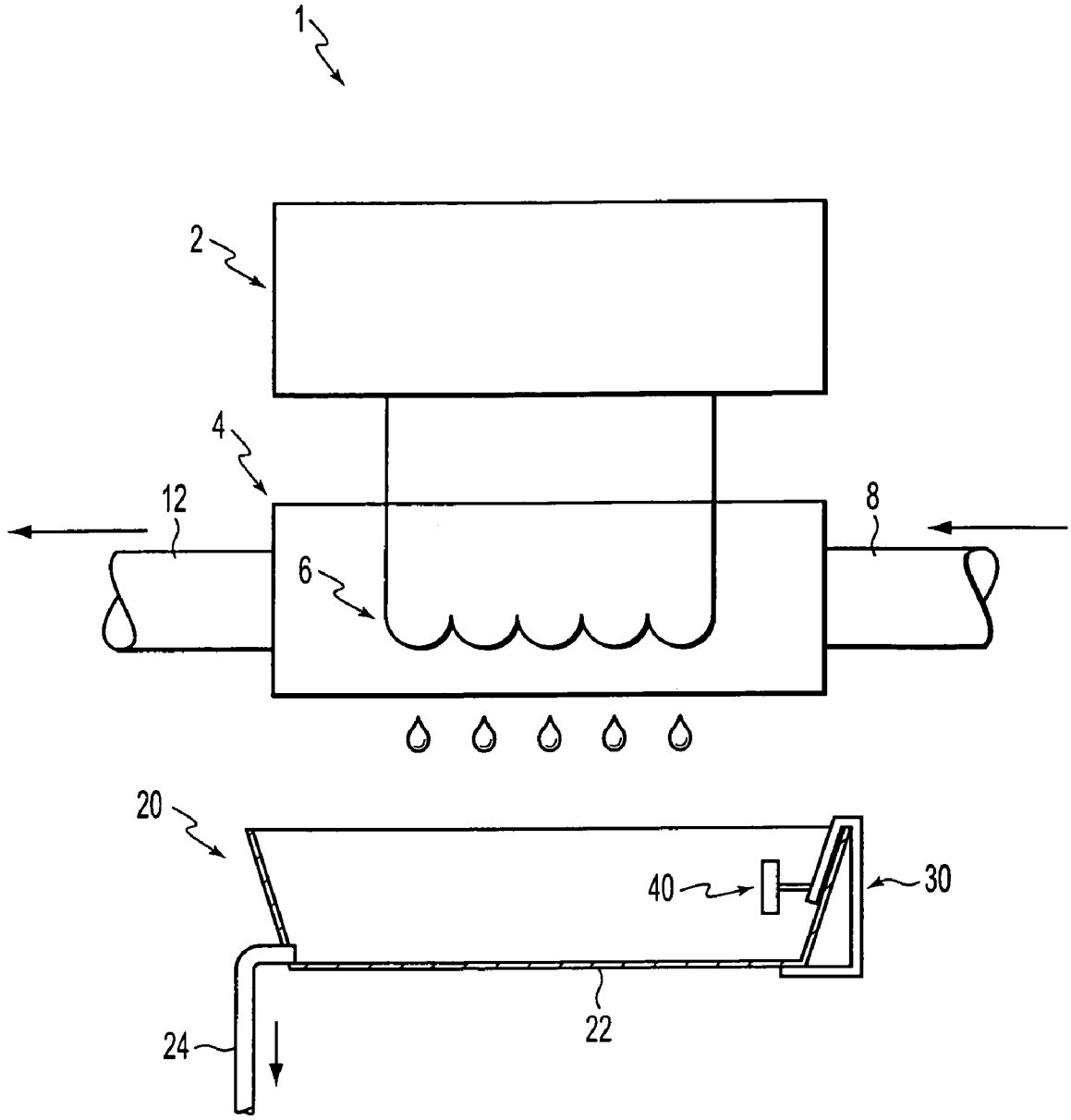
FIG. 1 is a view of an air cooling system incorporating a clamp assembly according to an embodiment of the invention.

FIG. 1 illustrates an air cooling system 1 including a drainage system 20 to which a clamp assembly 30 according to an embodiment of the invention is attached. The air cooling system 1 includes an air conditioner 2 coupled to an air handler 4. The air conditioner 2 circulates and cools a coolant passing through the air conditioner 2. The air handler 4 contains heat exchange coils 6 through which the cold coolant circulates. Warm air is conveyed to the air handler 4 through an inlet duct 8. The warm air is cooled as it makes contact with the exchange coils 6. The cool air is then transported away from the air handler 4 through an outlet duct 12. When the warm air is cooled, moisture in the air condenses on the heat exchange coils 6 as liquid droplets or condensate.

The drainage system 20 includes a drain pan 22 coupled to a drain line 24. The condensate produced by the heat exchange coils 6 drips into the drain pan 22, which is placed below the heat exchange coils 6. The condensate in the drain pan 22 drains away through the drain line 24. However, if a blockage occurs in the drain line 24, for example, due to accumulation of debris, algae, biological, etc., the condensate starts to accumulate and fill the drain pan 22.

According to an embodiment of the invention, a clamp assembly 30 attaches to the drain pan 22. A condensate overflow detection and/or prevention mechanism 40 attaches to the clamp assembly 30 and detects the presence of excess condensate in the drain pan 22. In various embodiments, the condensate overflow detection and/or prevention mechanism 40 may include one or more of a switch mechanism, a float mechanism, a visual and/or an audio alarm mechanism, a pump, etc. If excess condensate is detected, the condensate overflow detection and/or prevention mechanism 40 may trigger a visual and/or audio alarm to draw attention to the excess condensate in the drain pan 22. In another embodiment, the condensate overflow detection and/or prevention mechanism 40 may cause the air cooling system 1 to shut down. In another embodiment, the condensate overflow detection and/or prevention mechanism 40 may activate a pump, which may be attached to the clamp assembly 30, to pump the condensate out of the drain pan 22 through another drain line. These and other preventive measures may be taken to prevent the condensate from overflowing out of the drain pan 22. Various detection/prevention mechanisms may be used with the clamp assembly.

The following considerations were taken into account when designing the clamp assembly for a condensate overflow detection and/or prevention mechanism. The list below is only exemplative, and is not an exhaustive list.

1. The clamp assembly should attach to the drain pan in a stable way such that it will continuously remain in alignment with the pan so that the detection/prevention mechanism operates correctly at all times.
2. The clamp assembly should provide for the condensate overflow detection and/or prevention mechanism to be adjustable in the drain pan, so that the mechanism can be set to minimize an amount of condensate in the drain pan.
3. The clamp assembly should accommodate differing drain pan heights.
4. The clamp assembly should accommodate drain pan sides that may be vertical or sloped.
5. The clamp assembly should accommodate drain pans that have a reinforcing lip at the top of the vertical or sloped side.
6. In the event that components of the condensate overflow detection and/or prevention mechanism malfunction, the clamp assembly should provide for easy access and replacement of the malfunctioning component.
7. The clamp assembly should prevent a float from becoming obstructed by brushing against adjacent surfaces or by becoming adhered to the bottom or side of the drain pan by the sticky residue which may be present in the drain pan.

Figure 2:
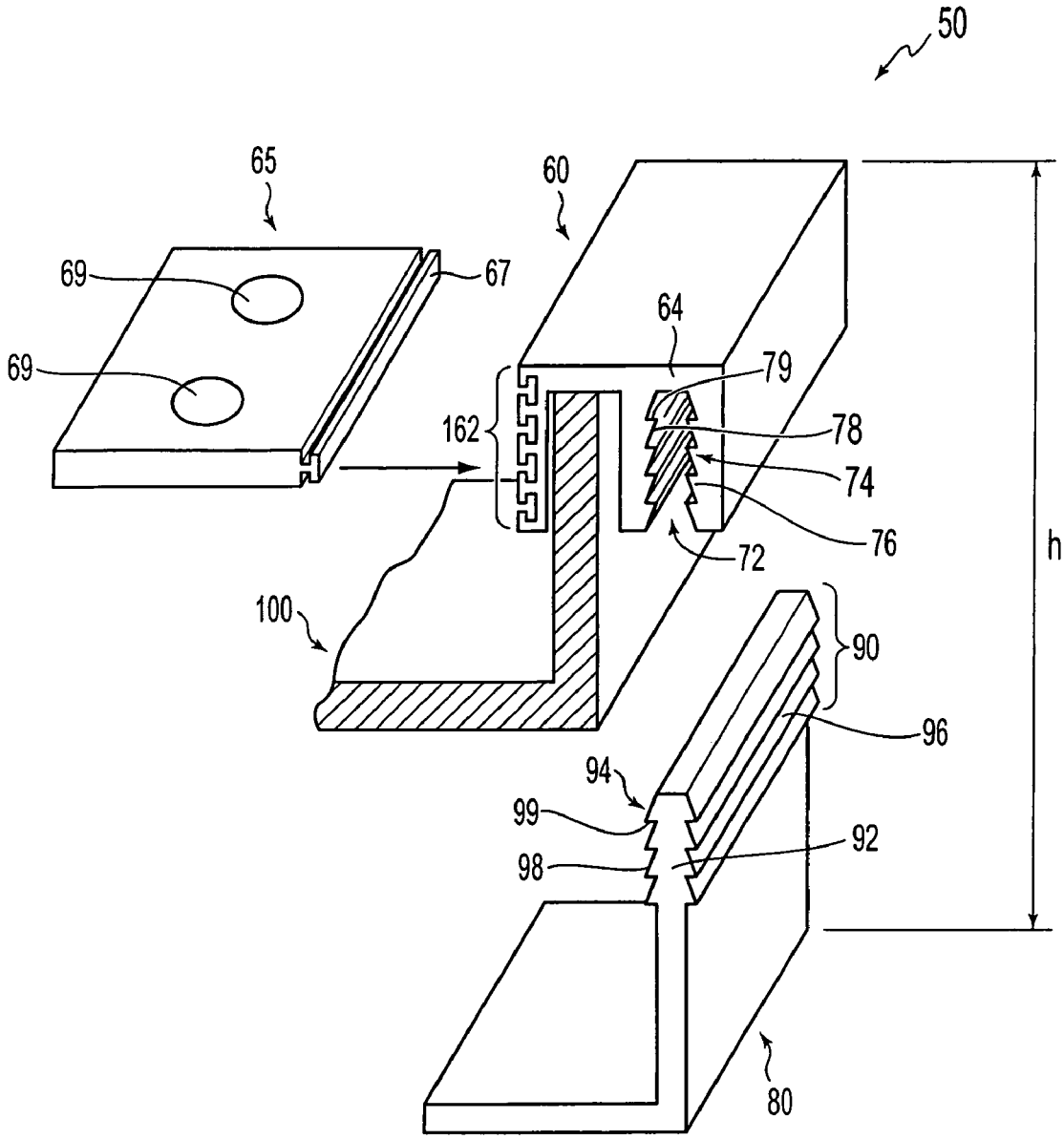
FIG. 2 illustrates an exemplary clamp assembly that includes a U-shaped clamp member and an L-shaped clamp member according to an embodiment of the invention.

FIG. 2 illustrates an exemplary clamp assembly 50 for a condensate overflow detection and/or prevention mechanism according to an embodiment of the invention. As shown in FIG. 2, the clamp assembly 50 has an elongated U-shaped clamp member 60 having a mating portion 70 that mates with a mating portion 90 of an elongated L-shaped clamp member 80. In this embodiment, the mating portion 70 of the U-shaped clamp member 60 is a guide channel 72 formed at an end of an arm of the U-shaped clamp member 60 and having a female ratchet mechanism 74 formed at inner surfaces of the guide channel 72. The mating portion 90 of the L-shaped clamp member 80 is a guide member 92 formed at an arm of the L-shaped clamp member 80 and having a male ratchet mechanism 94 formed at outer surfaces of the guide member 92. The guide member 92 engages and enters the guide channel 72 so that the female ratchet mechanism 74 in the guide channel 72 engages the male ratchet mechanism 94 on the guide member 92 to adjustably lock the U-shaped clamp member 60 and the L-shaped clamp member 80 together.

The female ratchet mechanism 74 includes a set of teeth 76 formed at regular intervals longitudinally along opposing inner surfaces of the guide channel 72. Each tooth 76 has a ramp portion 78 that faces an insertion end of the guide channel 72 and a shoulder portion 79. The teeth 76 are positioned such that a ramp portion 78 of a tooth 76 starts where a ramp portion 78 of an immediate tooth 76 ends. At the guide member 92, the male ratchet mechanism 94 is a set of teeth 96 formed at regular intervals along two opposite outer surfaces of the guide member 92. Each tooth 96 has a ramp portion 98 that faces an insertion end of the guide member 92 and a shoulder portion 99. The teeth 96 are positioned such that a ramp portion 98 of a tooth 96 starts where a ramp portion 98 of an immediate tooth 96 ends.

As the guide member 92 enters the guide channel 72, the ramp portion 98 of the teeth 96 on the guide member 92 slides against the ramp portion 78 of the teeth 76 in the guide channel due to the orientation of the teeth 76 of the guide channel 72 and the orientation of the teeth 96 of the guide member 92. Should the guide member 92 attempt to exit the guide channel 72, the shoulder portion 99 of the teeth 96 of the guide member 92 engage the shoulder portion 79 of the teeth 76 of the guide channel 72 thereby preventing the guide member 92 from exiting. Thus, the guide member 92 can enter progressively inward into the guide channel 72, but cannot exit outwardly from the guide channel 72.

Figure 3:
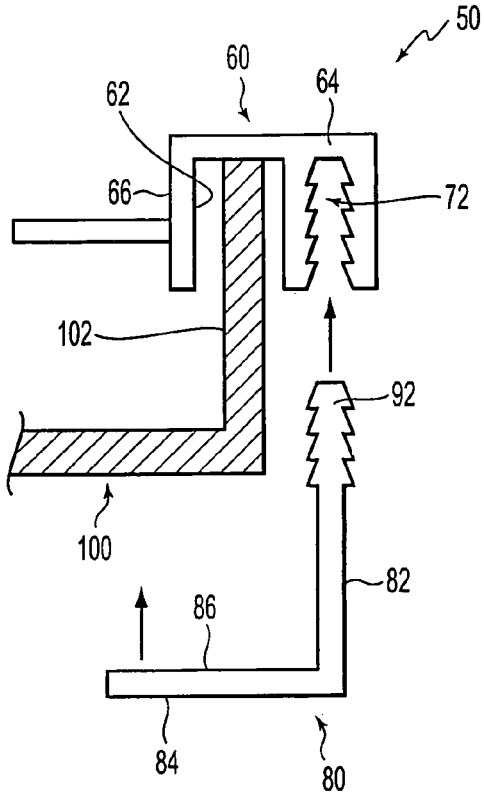
FIGS. 3–5 illustrate operation of the clamp assembly of FIG. 2 clamping onto a vertical side of a drain pan.
Figure 4:
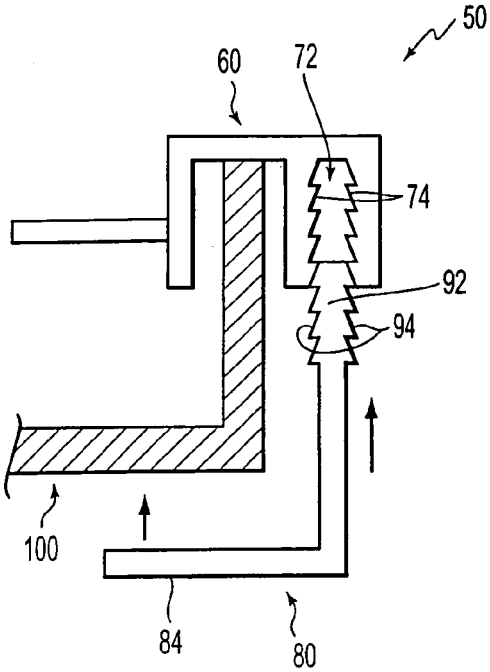
Figure 5:
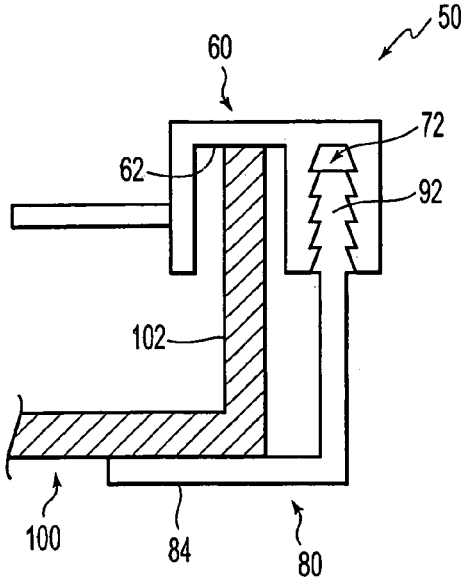

Referring now to FIGS. 3–5, the clamp assembly 50 clamps onto the drain pan 100 as follows: As shown in FIG. 3, an inner surface 62 of the U-shaped clamp member 60 is placed on an inner vertical side 102 of the drain pan 100. The inner surface 62 saddles at an edge of a vertical side 102 of the drain pan 100 with one arm 64 having the guide channel 72 exterior to the drain pan 100 and the other arm 66 interior to the drain pan 100. The L-shaped clamp member 80 is placed beneath the U-shaped clamp member 60 with the arm 82 having the guide member 92 aligned with the guide channel 72 of the U-shaped clamp member 60 and an upper surface 86 of the other arm 84 facing a bottom of the drain pan 100.

As shown in FIG. 4, as the guide member 92 of the L-shaped clamp member 80 enters the guide channel 72 of the U-shaped clamp member 60, the female ratchet mechanism 74 of the guide channel 72 engages the male ratchet mechanism 94 of the guide member 92. The guide member 92 enters the guide channel 72 in step lock increments. As the guide member 92 enters further into the guide channel 72, the upper surface of the arm 84 of the L-shaped clamp member 80 approaches the bottom of the drain pan 100.

As shown in FIG. 5, the guide member 92 enters the guide channel 72 until the upper surface of the arm 84 of the L-shaped clamp member 80 abuts the bottom of the drain pan 100. At this position, the U-shaped clamp member 60 in conjunction with the L-shaped clamp member 80 have clamped onto the vertical side 102 of the drain pan 100. In particular, the inner surface 62 of U-shaped clamp member 60 engages an upper surface of the drain pan 100, namely, the edge or lip of the vertical side 102. The engagement of the female ratchet mechanism 74 to the male ratchet mechanism 94 prevents the U-shaped clamp member 60 from separating from the L-shaped clamp member 80, and a tight fit is formed with the drain pan 100.

Referring back to FIG. 2, due to the step lock ratchet interaction between the female ratchet mechanism 74 of the guide channel 72 and the male ratchet mechanism 94 of the guide member 92, a height h of the clamp assembly 50 is adjustable such that the clamp assembly 50 can clamp onto various drain pans having different heights.

The U-shaped clamp member 60 further includes a mating portion 162 that mates with a mating portion 67 of a platform (or mounting member) 65. In this embodiment, the platform mating portion is a plurality of tee-shaped slots 162 on an inwardly facing side surface of the U-shaped clamp member 60. The mating portion of the platform 65 is a tee-shaped anchor 67 that attaches the platform 65 to the U-shaped clamp member 60 through one of the tee-shaped slots 162. The height of the platform 65 with respect to the drain pan 100 may be adjusted by inserting the platform 65 in the appropriate tee-shaped slot 162 of the U-shaped clamp member 60. The platform 65 includes one or more attachment structures 69 for receiving one or more of an overflow switch, a pump, a pump inlet, an alarm assembly, etc.

According to an embodiment of the invention, the length of the arm of the L-shaped clamp member that abuts the bottom of the drain pan is about 1–1.5 inches long. The width of the U-shaped clamp member and the L-shaped clamp member is about 2–3 inches long. The height of the clamp assembly may be adjustable from 1.5–4 inches, for example.

Figure 6:
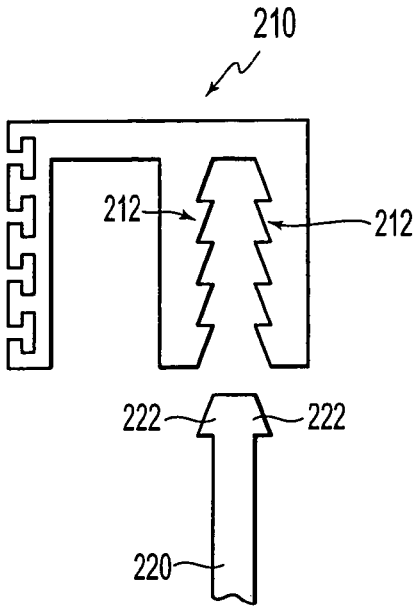
FIG. 6 illustrates a female ratchet mechanism of a U-shaped clamp member having a plurality of teeth on opposing inner surfaces of a guide channel and a male ratchet mechanism of an L-shaped clamp member having one tooth on opposite surfaces of a guide member according to an embodiment of the invention.
Figure 7:
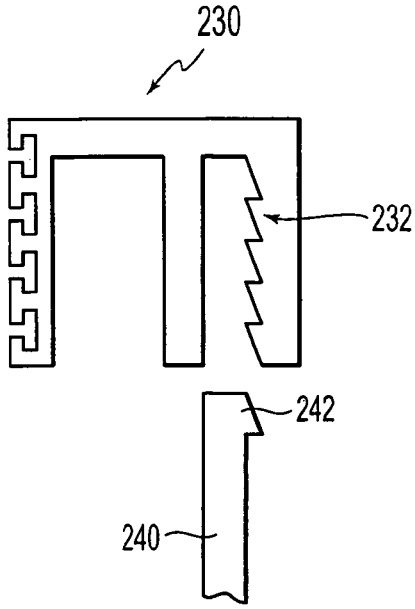
FIG. 7 illustrates a female ratchet mechanism of a U-shaped clamp member having a plurality of teeth on one surface of a guide channel and a male ratchet mechanism of the L-shaped clamp member having one tooth on a surface of a guide member according to an embodiment of the invention.
Figure 8:
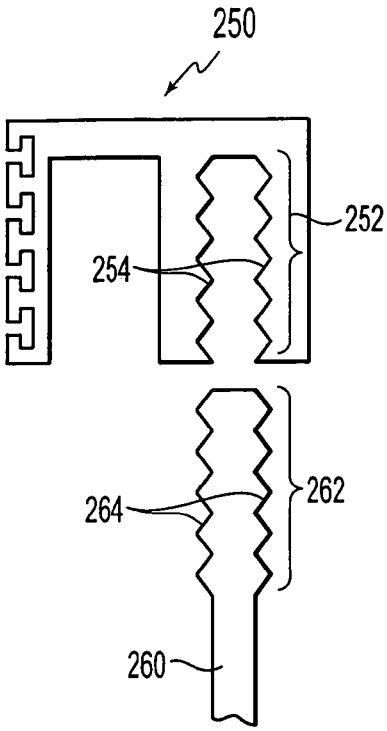
FIG. 8 illustrates a female mating portion of a U-shaped clamp member having a plurality of saw-shaped triangular teeth on opposing inner surfaces of a guide channel and a male mating portion of an L-shaped clamp member having a plurality of saw-shaped triangular teeth on opposite outer surfaces of a guide member according to an embodiment of the invention.
Figure 9:
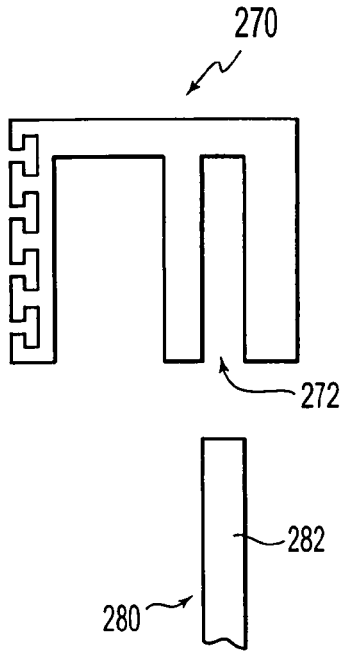
FIG. 9 illustrates a planar surfaced guide channel of a U-shaped clamp member and a planar surface guide member of an L-shaped clamp member, which are mated together using an adhesive material according to an embodiment of the invention.

FIGS. 6–9 illustrate various examples of a mating portion for a U-shaped clamp member and a mating portion for an L-shaped clamp member according to various embodiments of the invention. As shown in FIG. 6, a female ratchet mechanism 212 of the U-shaped clamp member 210 has a plurality of teeth. The guide member 220 of the L-shaped clamp member has a male ratchet mechanism 222 that has only one tooth on either side of the opposite surfaces of the guide member 220. FIG. 7 shows a female ratchet mechanism 232 of the U-shaped clamp member 230 that has a plurality of teeth on one inner surface of the guide channel. The guide member 240 has a male ratchet mechanism 242 that has only one tooth on a surface of the guide member 240 that engages the female ratchet mechanism 232 of the U-shaped clamp member 230. FIG. 8 shows a mating portion 252 that has a plurality of saw-shaped triangular teeth 254 formed on opposing inner surfaces of the guide channel of the U-shaped clamp member 250. The guide member 260 includes a mating portion 262 that has a corresponding plurality of saw-shaped triangular teeth 264 that engage the plurality of triangular teeth 254 of the mating portion 252 of the U-shaped clamp member 250. In this embodiment, the guide member 260 can more easily enter and exit the guide channel of the U-shaped clamp component 250. FIG. 9 shows a guide channel 272 of the U-shaped clamp member 270 and a guide member 282 of the L-shaped clamp member 280 where the inner surfaces of the guide channel 272 and the outer surfaces of the guide member 282 are smooth. In this embodiment, the guide member 282 is affixed to the guide channel 272 by using an adhesive material. As another alternative, the FIG. 9 guide member 282 may have a vertically extending elongated slot and the outer wall of the channel 272 may have a hole through which a set screw may pass to fixedly (but adjustably) attach the members 270 and 280 to each other. A variety of adjustable correction structures may be provided between the two clamp members (e.g., 270 and 280 in FIG. 9) of the clamp assembly.

Figure 10:
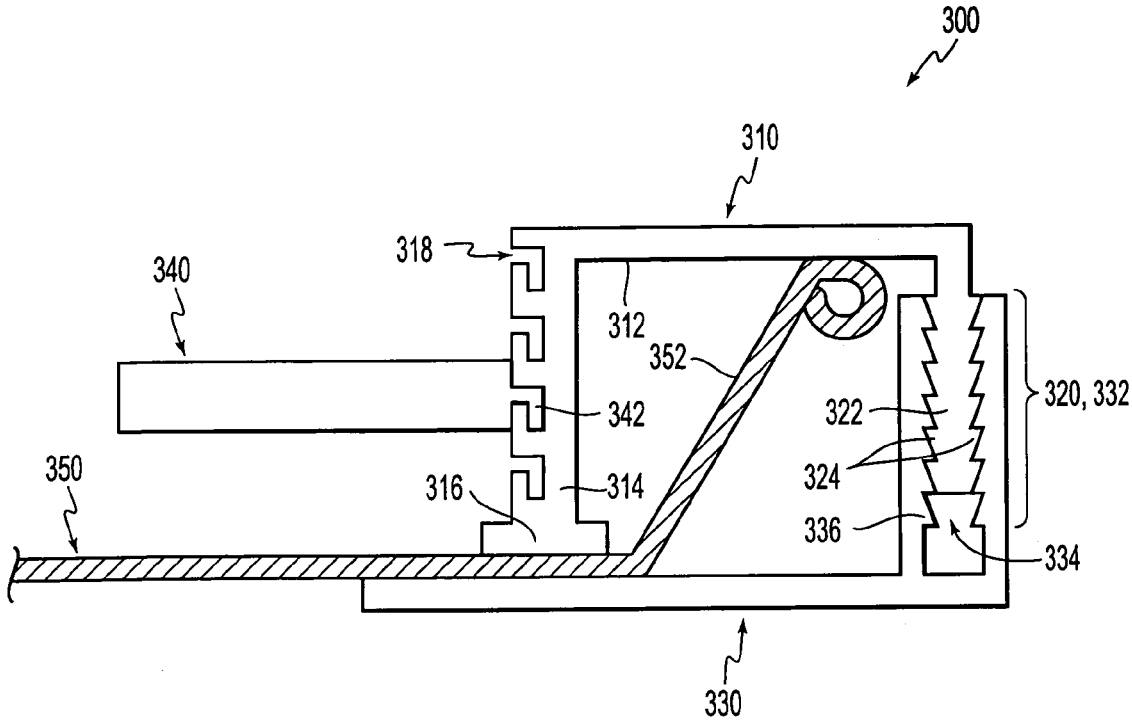
FIG. 10 illustrates an exemplary clamp assembly where a U-shaped clamp member has a wide inner surface to accommodate a sloped vertical side of a drain pan according to an embodiment of the invention.

FIG. 10 illustrates another exemplary clamp assembly 300 for a condensation overflow detection and/or prevention mechanism according to an embodiment of the invention. As shown in FIG. 10, the clamp assembly 300 has an elongated U-shaped clamp member 310 that mates with an elongated L-shaped clamp member 330. In this embodiment, a mating portion 320 of the U-shaped clamp member 310 is a guide member 322 having a male ratchet mechanism 324 formed at an end of an arm of the U-shaped clamp member 310. A mating portion 332 of the L-shaped clamp member 330 is a guide channel 334 having a female ratchet mechanism 336 formed at an end of an arm of the L-shaped clamp member 330. As the guide member 322 engages and enters the guide channel 334 of the L-shaped clamp member 330, the female ratchet mechanism 336 in the guide channel 334 engages the male ratchet mechanism 324 of the guide member 322 to clamp the U-shaped clamp member 310 and the L-shaped clamp member 330 onto the drain pan 350.

To accommodate for a sloped vertical side 352 of the drain pan 350, the U-shaped clamp member 310 has a U-shaped inner surface 312 that is sufficiently wide to cover the sloped vertical side 352 of the drain pan 350. In various embodiments, the U-shaped inner surface 312 is sufficiently wide to cover a rolled reinforcing lip that is molded onto the top edge of the sloped vertical side of the drain pan.

A support 316 can be formed at an arm 314 of the U-shaped clamp member 310, and rests at the interior upper surface of the drain pan 350. The support 316 may be formed to provide for a steadier footing of the U-shaped clamp member 310 at the bottom of the drain pan 350. In this embodiment, the clamp member 310 (in particular, the support 316) contacts the upper surface of the drain pan on the interior of the pan instead of at the lip or edge of the side 352.

The U-shaped clamp member 310 further includes a platform mating portion to allow a platform to attach to the U-shaped clamp member 310. In this embodiment, the platform mating portion includes a plurality of hook-shaped or bracket-shaped slots 318 on an inwardly-facing outer side surface of the U-shaped clamp member 310. A platform 340 has a mating portion to attach to the U-shaped clamp member. In this embodiment, the mating portion of the platform is a hook-shaped or bracket-shaped anchor 342 that mates with one of the hook-shaped or bracket-shaped slots 318. The platform 340 includes one or more attachment structures (not shown) for receiving one or more of an overflow switch, a pump, a pump inlet, an alarm assembly, etc. A height of the platform 340 with respect to the drain pan may be adjusted by inserting the platform 340 in one of the hook-shaped or bracket-shaped slots 318 of the U-shaped clamp member 310.

Figure 11:
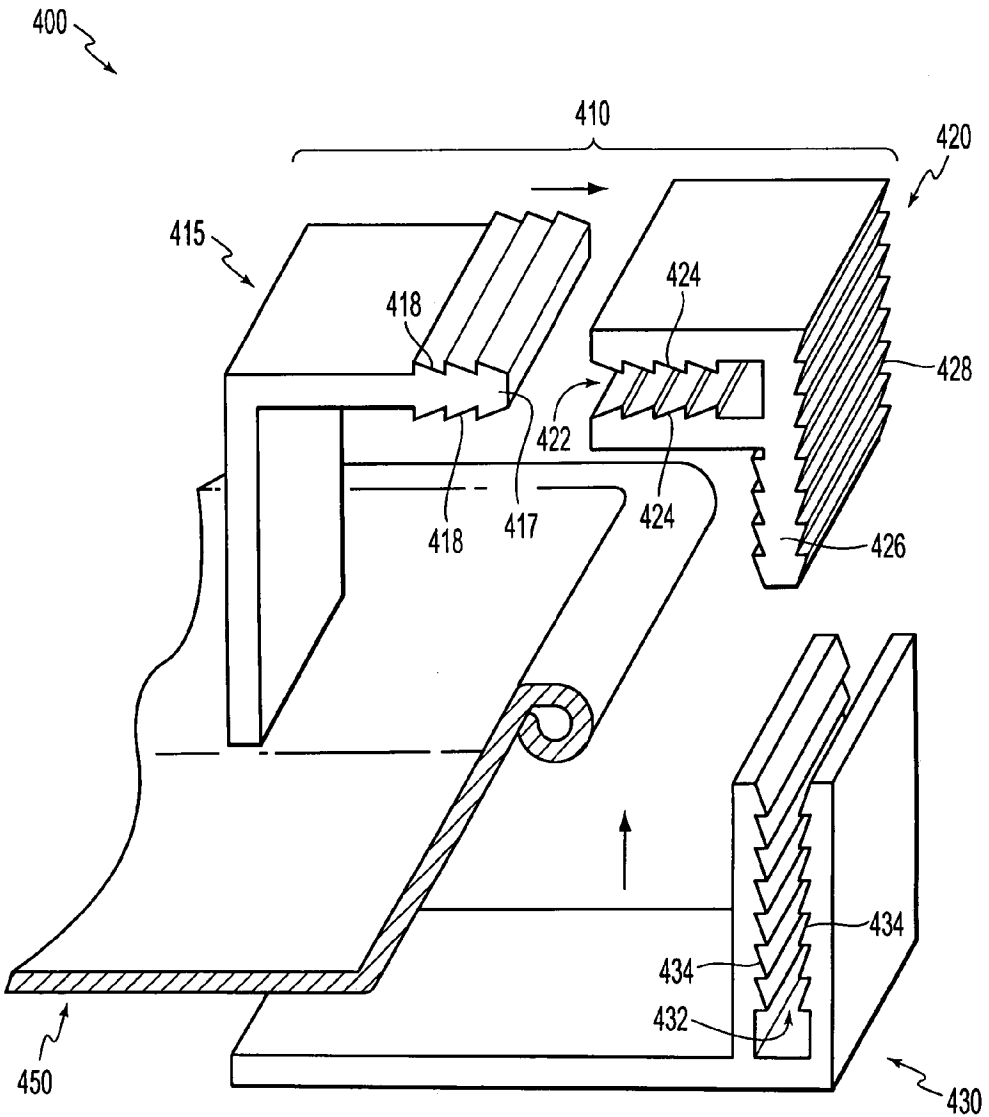
FIG. 11 illustrates an exemplary clamp assembly where the U-shaped clamp member is formed from two L-shaped clamp members to accommodate vertical sides of drain pans of various slopes according to an embodiment of the invention.

FIG. 11 illustrates another exemplary clamp assembly 400 for the condensation overflow detection and/or prevention mechanism according to an embodiment of the invention. As shown in FIG. 11, the clamp assembly 400 has an elongated U-shaped clamp member 410 that mates with an elongated L-shaped clamp member 430. The U-shaped clamp member 410 includes two L-shaped members 415 and 420 that mate to form the U-shaped clamp member 410. The first L-shaped member 415 has a mating portion that mates with a mating portion of the second L-shaped member 420. In this embodiment, the mating portion of the L-shaped member 415 is a guide member 417 and a male ratchet mechanism 418 formed at an arm of the L-shaped member 415. The mating portion of the second L-shaped member 420 is a guide channel 422 and a female ratchet mechanism 424 formed at an arm of the L-shaped clamp member 420. When the guide member 417 of the first L-shaped member 410 enters the guide channel 422 of the second L-shaped member 420, the male ratchet mechanism 418 engages the female ratchet mechanism 424 in a step lock ratchet manner to form the U-shaped clamp member 410.

Due to the step lock ratchet interaction between the female ratchet mechanism 424 of the guide channel 422 and the male ratchet mechanism 418 of the guide member 417, a width of the U-shaped clamp member 410 is adjustable such that the clamp assembly 400 can accommodate various drain pans having vertical sides with various slopes.

The second L-shaped member 420, now integrated with the first L-shaped member 415 to form the U-shaped clamp member 410, further includes another mating portion at the other arm of the second L-shaped member 420. In this embodiment, the mating portion at the other arm is a guide member 426 having a male ratchet mechanism 428. The mating portion at the other arm of the L-shaped member 420 mates with the mating portion of the L-shaped clamp member 430. In this embodiment, the mating portion of the L-shaped clamp member is a guide channel 432 and a female ratchet mechanism 434. As the guide member 426 of the U-shaped clamp member 410 engages and enters the guide channel 432 of the L-shaped clamp member 430, the male ratchet mechanism 428 of the guide member 426 engages the female ratchet mechanism 434 in the guide channel 432 of the L-shaped clamp member 430 to clamp the U-shaped clamp member 410 and the L-shaped clamp member 430 onto the drain pan 450.

Figure 12:
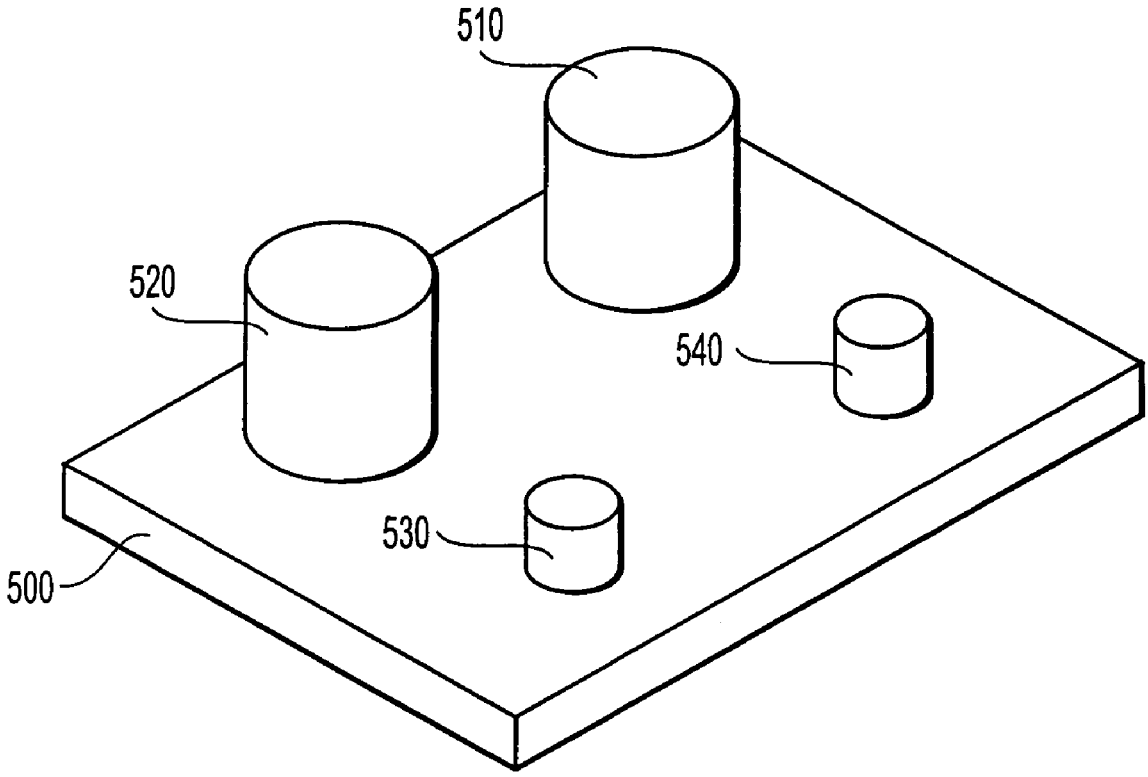
FIG. 12 illustrates an exemplary platform including a switching mechanism, a fluid sensor, a fluid pump and an annunciator according to an embodiment of the invention.

FIG. 12 illustrates a platform 500 for use with a clamp assembly for a condensate overflow detection and/or prevention mechanism according to an embodiment of the invention. As shown in FIG. 12, the platform includes a switch mechanism 510, a fluid pump 520, a fluid sensor 530 and an annunciator 540. In other embodiments of the invention, the platform may accommodate one or more of these devices suitable for the purpose in which the clamp assembly is to be used. When the clamp assembly including the platform 500 is attached to a drain pan, the fluid sensor 530 senses a level of fluid in the drain pan. If the fluid level exceeds a predetermined level, the fluid sensor 530 causes the switch mechanism 510 to be activated. Additionally, the annunciator 540 may be activated to alert that the drain pan has excess fluid. The switch mechanism 510 activates the fluid pump 520 to pump the fluid away from the drain pan and into a drain line coupled to the fluid pump 520. As an alternative, the switch mechanism 510 can activate an external annunciator (e.g., an alarm) or switch off the air-handling system or both.

Thus, according to the invention, a clamp assembly includes first and second clamp member that are attachable to each other. The first clamp member includes a first engaging portion that engages a first surface of the drain pan, and the second clamp member includes a second engaging portion that engages a second surface of the drain pan. The first surface can be, for example, a lower surface of the drain pan. The second surface, can be, for example, an upper surface of the drain pan, for example, and edge or lip of the side of the drain pan, or the upper surface of the bottom wall of the drain pan. The invention, however, is not limited to only engaging those surfaces of the drain pan. For example, the first and second clamp members could have first and second engaging portions that engage the inner and outer surfaces of the drain pan side. Such an arrangement would be particularly for pans having vertical side walls.

The clamp assembly also includes a locking mechanism that locks the first and second clamp members to each other so that the drain pan is clamped between the first and second clamp members. According to a preferred embodiment, the locking mechanism includes a ratchet-type mechanism in which teeth members are provided on portions of the first and second clamp members. However, as discussed above, other types of locking mechanisms can be used instead of a ratchet-type mechanism. For example, an adhesive could be used, set screws could be used that are inserted through elongated slots. Any structure that allows for adjustable attachment so that the clamp assembly can be used with drain pans of various sizes can be used with the invention.

In addition, a mounted member is provided on the second clamp member. The mounting member is provided so that the condensate overflow detection and/or prevention mechanism can be mounted thereto. The mounting member preferably is adjustably attachable to the second clamp member so that the height of the detection and/or prevention mechanism can be easily adjusted.

In various embodiments, the switch mechanism can be mechanical, single or multiple electronic probe or sensor, reed type, ultrasonic, optical, light fiber, pneumatic or can use any other known switching method, or any combination of the above, all of which can be capable of single or multiple pole switching for the purpose of carrying out simultaneous multi-switching operations without the necessity of any extra relays. An electrical overflow switch may operate on a battery, a 6 volt, a 12 volt, a 24 volt, a 120 volt, a 220 volt, or any other voltage AC or DC, which may prove to be practical, for example, for the purpose of connecting into an electrical building monitoring system or meeting current or future building codes.

If the switch mechanism uses a float, it is preferable that, the float may be fabricated from a material which is impervious to chemicals, chemical fumes, and is not attracted to, or capable of being removed or damaged by birds, rodents or insects. The float should be designed in such a way that it is protected from obstruction by proximity to nearby surfaces and is not subject to adherence to the sides or bottom of the drain pan. A height of the platform may be suitably adjusted to bring about this desired result.

In various embodiments, the annunciator may be an optional integral warning lamp and/or audible alarm to alert service personnel or owners on a local level that the high condensate level has occurred. The annunciator may be connected to the switch mechanism by electrical wires or the annunciator may be wirelessly connected. When the switch mechanism is activated by a float mechanism, the switch mechanism activates the annunciator to alert the owner that excess condensate has accumulated in the drain pan.

The annunciator may communicate directly with the air cooling system and/or an external alarm by means of wiring, wireless RF frequency, infrared, ultraviolet, ultrasonic or any of the known communication technology or any combination of the above.

The pump drains directly from the drain pan itself, or the pump can be connected via a flexible tube to a specially placed inlet inside a drain pan which can be integrated into the drain pan structure, or the pump can be retrofitted to the drain pan after installation of the air cooling system.

While this invention has been described in conjunction with exemplary embodiments outlined above, it is evident that many alternatives, modifications and variations will be apparent to those skilled in the art. Accordingly, exemplary embodiments of the invention, set forth above, tend to be illustrative, and not limiting. Various changes may be made without departing from the spirit and scope of the invention.

What is claimed is:

1. A clamp assembly for attachment to a condensate drain pan of an air-cooling system, the clamp assembly comprising:

a first clamp member having a first engaging portion that engages a first surface of a wall of the drain pan;

a second clamp member having a second engaging portion that engages a second surface of the drain pan, which is different from side surfaces of the wall of the drain pan; and a locking mechanism that locks the first and second clamp members to each other so that the drain pan is locked between the first and second clamp members.

2. A method of attaching the clamp assembly of claim 1 to the condensate drain pan of an air-cooling system, the method comprising:

engaging the first engaging portion of the first clamp member with the first surface of the drain pan;

engaging the second engaging portion of the second clamp member with the second surface of the drain pan; and locking the first and second clamp members to each other so that the drain pan is locked between the first and second clamp members.

3. A clamp assembly for attachment to a condensate drain pan of an air-cooling system, the clamp assembly comprising:

a first clamp member having a first engaging portion that engages a first surface of the drain pan;

a second clamp member having a second engaging portion that engages a second surface of the drain pan, which is different the first surface of the drain pan, wherein the first engaging portion is adapted to engage a lower surface of the drain pan, and the second engaging portion is adapted to engage an upper surface of the drain pan; and a locking mechanism that locks the first and second clamp members to each other so that the drain pan is locked between the first and second clamp members.

4. The clamp assembly of claim 3, wherein the second engaging portion is adapted to engage an edge of a side of the drain pan.

5. The clamp assembly of claim 3, wherein the second engaging portion is adapted to engage an interior surface of the drain pan.

6. The clamp assembly of claim 3, wherein the locking mechanism adjustably locks the first and second clamp members to each other.

7. The clamp assembly of claim 3, further comprising a mounting member attached to the first clamp member, the mounting member for mounting a sensing mechanism thereon that detects a liquid level in the drain pan.

8. The clamp assembly of claim 7, wherein the mounting member includes at least one of a switching mechanism, a fluid pump, a fluid sensor and an annunciator.

9. The clamp assembly of claim 7, wherein the mounting member is adjustably attachable to the first clamp member so that a height of the sensing mechanism can be adjusted.

10. A method of attaching the clamp assembly of claim 3 to the condensate drain pan of an air-cooling system, the method comprising:

engaging the first engaging portion of the first clamp member with the first surface of the drain pan;

engaging the second engaging portion of the second clamp member with the second surface of the drain pan; and locking the first and second clamp members to each other so that the drain pan is locked between the first and second clamp members.

11. The clamp assembly of claim 3, wherein the first and second lock members include a plurality of teeth.

12. A clamp assembly for attachment to a condensate drain pan of an air-cooling system, the clamp assembly comprising:

a first clamp member having a first engaging portion that engages a first surface of the drain pan;

a second clamp member having a second engaging portion that engages a second surface of the drain pan, which is different from the first surface of the drain pan; and a locking mechanism that locks the first and second clamp members to each other so that the drain pan is locked between the first and second clamp members, wherein the locking mechanism includes a first lock member provided on the first clamp member, and a second lock member provided on the second clamp member.

13. The clamp assembly of claim 12, wherein the first and second lock members include a plurality of teeth.

14. The clamp assembly of claim 12, wherein the locking mechanism adjustably locks the first and second clamp members to each other.

15. The clamp assembly of claim 12, further comprising a mounting member attached to one of the first and second clamp members, the mounting member for mounting a sensing mechanism thereon that detects a liquid level in the drain pan.

16. The clamp assembly of claim 15, wherein the mounting member including at least one of switching mechanism, a fluid pump, a fluid sensor and an annunciator.

17. The clamp assembly of claim 15, wherein the mounting member is adjustably attached to the one of the first and second clamp members so that a height of the sensing mechanism can be adjusted.

18. A method of attaching the clamp assembly of claim 12 to the condensate drain pan of an air-cooling system, the method comprising:

engaging the first engaging portion of the first clamp member with the first surface of the drain pan;

engaging the second engaging portion of the second clamp member with the second surface of the drain pan; and locking the first and second clamp members to each other so that the drain pan is locked between the first and second clamp members.

19. A clamp assembly for attachment to a condensate drain pan of an air-cooling system, the clamp assembly comprising:

a first clamp member that engages a first surface of the drain pan;

a second clamp member that engages a second surface of the drain pan, which is different from the first surface of the drain pan;

the first and second clamp members respectively having first and second mating means for mating with each other; and the second clamp member including means for supporting a sensing mechanism thereon that detects a liquid level in the drain pan;

wherein when the first and second mating means are mated with each other, the drain pan is clamped between the first and second clamp members, so that the clamp assembly is clamped to the drain pan.

20. The clamp assembly of claim 19, wherein the supporting means includes at least one of a switching mechanism, a fluid sensor, a fluid pump and an annunciator.

21. The clamp assembly of claim 19, wherein the means for supporting the sensing mechanism is adjustably attached to the second clamp member so that a height of the sensing mechanism relative to the drain pan can be adjusted.

22. A method of attaching the clamp assembly of claim 19 to the condensate drain pan of an air-cooling system, the method comprising:

engaging the first clamp member to the first surface of the drain pan;

engaging the second clamp member to the second surface of the drain pan; and mating the first and second clamp member with each other so that the drain pan is clamped between the first and second clamp members.

23. A clamp assembly for attachment to a condensate drain pan of an air-cooling system, the clamp assembly comprising:

a U-shaped clamp member, an inner surface of the U-shaped clamp member saddling a side of the drain pan, and a first end of the U-shaped clamp member having a first mating portion; and an L-shaped clamp member, an end of the L-shaped clamp member having a second mating portion that mates with the first mating portion of the U-shaped clamp member, wherein at least a portion of an inner surface of the L-shaped clamp member at least partially abuts a bottom surface of the drain pan.

24. The clamp assembly of claim 23, wherein the first mating portion of the U-shaped clamp member includes an opening at the first end of the U-shaped clamp member and an inner surface of the opening has at least one tooth.

25. The clamp assembly of claim 24, wherein the first mating portion includes a plurality of teeth, the teeth are positioned in increments on at least one inner surface of the opening.

26. The clamp assembly of claim 25, wherein the plurality of teeth form a female ratchet mechanism.

27. The clamp assembly of claim 23, wherein the second mating portion of the L-shaped clamp member has at least one tooth on an outer surface of the L-shaped clamp member.

28. The clamp assembly of claim 27, wherein the second mating portion includes a plurality of teeth, the teeth are positioned in increments on at least one outer surface of the L-shaped clamp member.

29. The clamp assembly of claim 28, wherein the plurality of teeth form a male ratchet mechanism.

30. The clamp assembly of claim 23, wherein an outer side surface of the U-shaped clamp member includes a third mating portion.

31. The clamp assembly of claim 30, wherein the third mating portion includes at least one tee slot.

32. The clamp assembly of claim 30, wherein the third mating portion includes a plurality of tee slots, the tee slots are positioned in increments on the outer side surface of the U-shaped clamp member.

33. The clamp assembly of claim 30, further comprising:

a platform including a fourth mating portion, wherein the fourth mating portion of the platform mates with the third mating portion of the U-shaped clamp member.

34. The clamp assembly of claim 33, wherein the fourth mating portion is a tee-shaped anchor.

35. The clamp assembly of claim 33, wherein the platform is adapted to receive a sensing mechanism that detects a liquid level in the drain pan.

36. The clamp assembly of claim 33, wherein the platform includes at least one of a switching mechanism, a fluid sensor, a fluid pump and an annunciator.

37. The clamp assembly of claim 23, wherein the U-shaped clamp member comprises:

a first L-shaped sub-member having a fifth mating portion; and a second L-shaped sub-member having a sixth mating portion, wherein the fifth mating portion mates with the sixth mating portion to form the U-shaped clamp member.

38. A method of attaching the clamp assembly of claim 23 to the condensate drain pan of an air-cooling system, the method comprising:

saddling the inner surface of the U-shaped clamp member to the side of the drain pan;

at least partially abutting the bottom surface of the drain pan with at least the portion of the inner surface of the L-shaped clamp member; and mating U-shaped clamp member with the L-shaped clamp member so that the drain pan is clamped between the U-shaped and L-shaped clamp members.

* * * * *